US008713716B2

(12) United States Patent
Krueger

(10) Patent No.: US 8,713,716 B2
(45) **Date of Patent: *May 6, 2014**

(54) IMPACT REDUCTION SYSTEM

(71) Applicant: Wesley W. O. Krueger, San Antonio, TX (US)

(72) Inventor: Wesley W. O. Krueger, San Antonio, TX (US)

(73) Assignee: Wesley W. O. Krueger, San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/674,755

(22) Filed: Nov. 12, 2012

(65) Prior Publication Data

US 2013/0125295 A1 May 23, 2013

Related U.S. Application Data

(63) Continuation-in-part of application No. 12/728,073, filed on Mar. 19, 2010, now Pat. No. 8,347,421, which is a continuation-in-part of application No. 11/828,326, filed on Jul. 25, 2007, now Pat. No. 7,917,972.

(51) Int. Cl.
*A44B 3/00* (2006.01)

(52) U.S. Cl.
USPC ..... 2/412

(58) Field of Classification Search
USPC ..... 2/16, 455, 94, 267, 412, 69, 108, 459, 2/DIG. 3
See application file for complete search history.

(56) References Cited

U.S. PATENT DOCUMENTS

| | | | | | |
|---|---|---|---|---|---|
| 1,587,946 | A * | 6/1926 | Gibson | 2/459 |
| 1,774,060 | A * | 8/1930 | Hodge | 42/74 |
| 2,438,142 | A * | 3/1948 | Brower | 42/74 |
| 3,257,666 | A * | 6/1966 | Hoffman | 2/459 |
| 3,872,511 | A * | 3/1975 | Nichols | 2/413 |
| 4,353,133 | A * | 10/1982 | Williams | 2/459 |
| 4,375,108 | A * | 3/1983 | Gooding | 2/413 |
| 4,493,115 | A * | 1/1985 | Maier et al. | 2/459 |
| 4,922,641 | A * | 5/1990 | Johnson | 42/74 |
| 5,095,545 | A * | 3/1992 | Lane | 2/68 |
| 5,265,366 | A * | 11/1993 | Thompson | 42/74 |
| 5,375,360 | A * | 12/1994 | Vatterott | 42/74 |
| 5,461,813 | A * | 10/1995 | Mazzola | 42/74 |
| 6,029,962 | A * | 2/2000 | Shorten et al. | 267/145 |
| 6,257,562 | B1 * | 7/2001 | Takashima et al. | 267/141.1 |

(Continued)

*Primary Examiner* — Tejash Patel
(74) *Attorney, Agent, or Firm* — Kilpatrick Townsend & Stockton LLP

(57) ABSTRACT

A wearable impact reduction device including a first layer, a second layer, a third layer, and a fourth layer. The first layer is located closest to the wearer's body and includes a flexible material configured to conform to the shape of a user's body. The fourth layer is located furthest from the wearer's body and is more rigid than the first layer whereby the fourth layer can distribute an external impact over a region. The second layer is placed between the first layer and the third layer. The third layer is placed between the second layer and the fourth layer. The second layer includes an elastically-deformable material having at least one resilient impression arranged and configured to at least partially compress upon application of a force and to return elastically to its original shape upon removal of the force. The third layer comprises an elastically-deformable material having at least one resilient impression arranged and configured to: contact and transmit a force to said resilient impression in the second layer, at least partially compress upon application of a force, and return to its original shape upon removal of a force.

23 Claims, 18 Drawing Sheets

(56) References Cited

U.S. PATENT DOCUMENTS

| | | | | |
|---|---|---|---|---|
| 6,453,477 | B1 * | 9/2002 | Bainbridge et al. | 2/455 |
| 6,588,023 | B1 * | 7/2003 | Wright | 2/459 |
| 6,684,547 | B2 * | 2/2004 | Poff, Jr. | 42/1.06 |
| 6,758,466 | B2 * | 7/2004 | Russell | 267/219 |
| 6,834,456 | B2 * | 12/2004 | Murello | 42/74 |
| 6,976,333 | B2 * | 12/2005 | Sims | 42/74 |
| 7,055,277 | B2 * | 6/2006 | Sims | 42/74 |
| 7,082,621 | B1 * | 8/2006 | Fratesi | 2/227 |
| 7,152,356 | B2 * | 12/2006 | Sims | 42/74 |
| 7,168,104 | B2 * | 1/2007 | Tobergte | 2/459 |
| 7,232,118 | B2 * | 6/2007 | Maeno et al. | 267/140.3 |
| 7,376,978 | B2 * | 5/2008 | Godshaw | 2/24 |
| 7,774,866 | B2 * | 8/2010 | Ferrara | 2/455 |
| 7,917,972 | B1 * | 4/2011 | Krueger | 2/459 |
| 8,347,421 | B2 * | 1/2013 | Krueger | 2/459 |
| 2006/0254112 | A1 * | 11/2006 | Snoderly | 42/74 |

* cited by examiner

IMPACT REDUCTION SYSTEM

CROSS-REFERENCE TO RELATED APPLICATIONS

This application is a continuation-in-part of U.S. application Ser. No. 12/728,073 filed Mar. 19, 2010, which is a continuation-in-part of U.S. application Ser. No. 11/828,326, filed Jul. 25, 2007, now U.S. Pat. No. 7,917,972, which are hereby incorporated by reference in their entirety.

BACKGROUND

The present invention generally relates to devices for absorbing shock. More particularly, the present invention relates to impact reduction devices for use in contact sports, gravity game sports, marksmanship, military or security activities, or other activities where protection from impact or projectiles is desired. Impact reduction devices may be directly placed against a part of the human body, they may be incorporated into an article of clothing, they may be part of a helmet, or they may be part of a device external to the user's body that serves to help reduce impact and/or prevent the penetration of projectiles.

Protective pads are used in a variety of applications to protect the body from injury-causing physical impact. For example, athletes often wear protective pads while playing sports, such as American football, hockey, soccer, gravity game sports, and baseball, among others. In addition, many marksmen wear protective pads while shooting firearms to increase their accuracy and protect their bodies from forces associated with firearm recoil.

In the case of marksmanship, not only will the recoil of a gun cause potential injury, but it may also affect the accuracy of the marksman. For example, if the marksman anticipates a recoil, he may flinch upon firing the gun. This flinching may disturb the alignment of the gun as it is fired leading to missed shots and inaccuracies. Use of a device to absorb the shock of the recoil may help to avoid flinching because the impact of the recoil against the marksman's body be softened.

In the athletic industry, many pads are constructed of high-density molded plastic material combined with open or closed cell foam padding. This padding is stiff and absorbs the energy of an impact force, dissipating that energy over an expanded area. Thus any one point of the body is spared the full force of the impact, thereby reducing the chance of injury.

Another type of pad often used in the athletic industry utilizes a honeycomb structure designed to be rigid in the direction of the impact, but flexible in a direction perpendicular to the impact. Upon application of an impact force, the honeycomb structure is deformed or crumpled in order to absorb as much of the potentially damaging impact as possible. In this way, less of the total kinetic energy of the impact is transferred to the body, while the impact reduction remains in the plane of the impact.

Similarly, in the firearm industry, a marksman may use a recoil buffer or arrestor to cushion the impact of a firearm as it recoils. Many recoil buffers are pads formed of a resilient material, such as leather, gel, foam, or rubber. Pads may be worn on the marksman's body or they may be formed as an integral part of a firearm, such as a rubber butt pad on a shotgun. The purpose of recoil buffers is similar to that of the athletic pads discussed above. That is, to absorb and disperse the energy of a recoil impact to protect the body of the marksman.

There are shortcomings with pads currently available for use in athletic and marksmanship applications. For example, athletes must often be quick and have freedom of movement. Existing athletic padding is generally heavy and bulky. In the case of padding having a honeycomb structure, the padding is rigid. Thus, use of existing pads decreases the ability of an athlete to move quickly and limits the athlete's freedom of movement. Many football players, for example, avoid the use of hip or thigh pads because of their weight, bulkiness, and the limiting effect that such pads have on mobility.

In the case of firearms, existing recoil buffers too often fail to disperse the kinetic energy of a recoil in a broad way. The result is that the full impact force of the recoil is concentrated in a localized area, resulting in flinching and possible injury.

Therefore, it is desirable to provide an impact reduction pad that overcomes the disadvantages of the prior art.

SUMMARY

One aspect of the present invention provides pads and systems incorporating pads that have improved impact reduction as a result of the geometries, configuration, and/or materials chosen. Another aspect of the present invention provides pads and systems incorporating pads that have increased intelligence in the form of sensors and information processing.

BRIEF DESCRIPTION OF THE DRAWINGS

The present invention will be better understood on reading the following detailed description of non-limiting embodiments thereof, and on examining the accompanying drawings, in which.

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It should be understood that various changes could be made in the function and arrangement of elements without departing from the spirit and scope as set forth in the appended claims.

Specific details are given in the following description to provide a thorough understanding of the embodiments. However, it will be understood by one of ordinary skill in the art that the embodiments may be practiced without these specific details.

Figure 1:
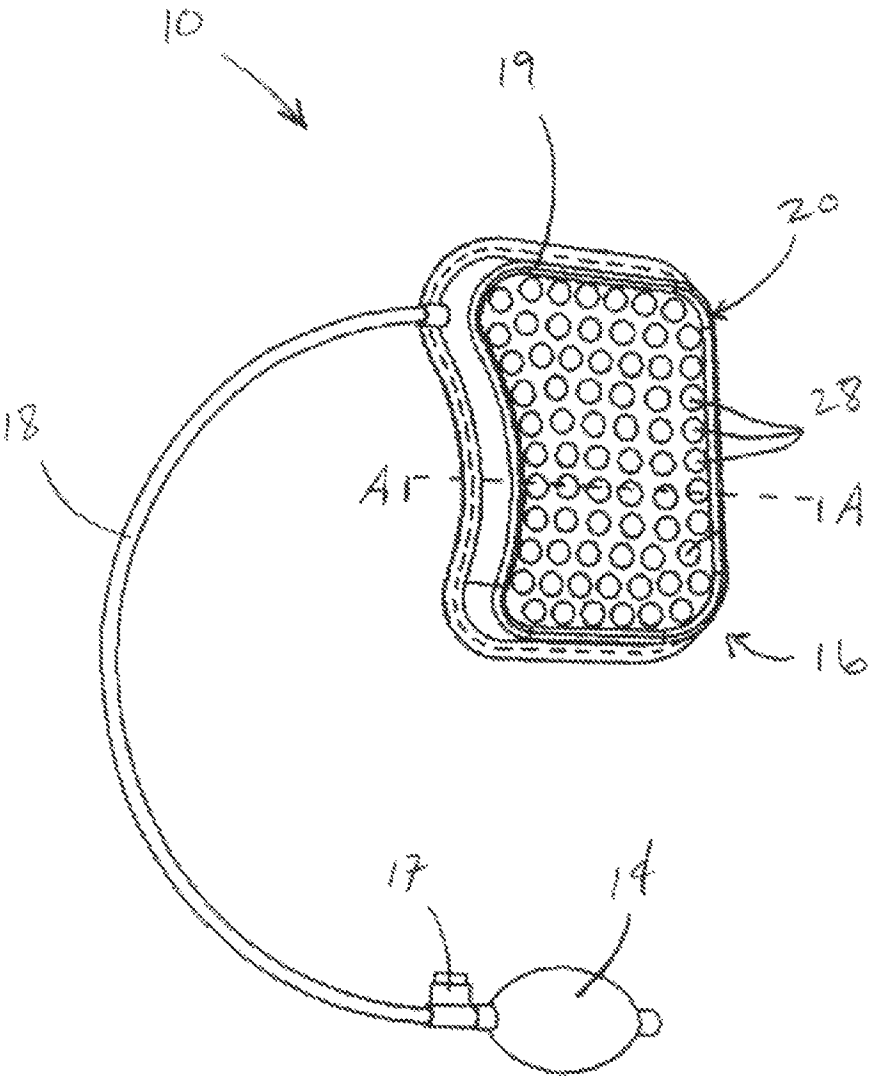
FIG. 1 is a front, perspective view of an embodiment of the present invention.
Figure 2:
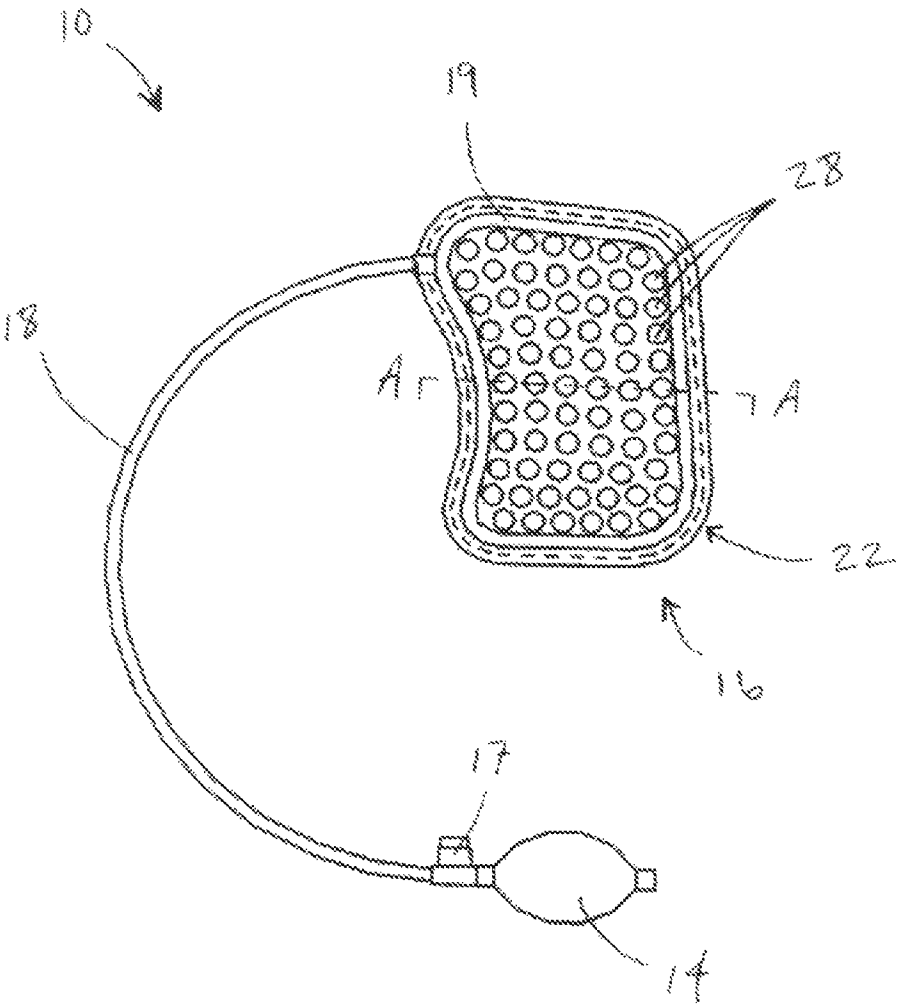
FIG. 2 is a back, perspective view of the embodiment of FIG. 1.

Referring now to the drawings, FIGS. 1 and 2 show an impact reduction device 10 in accordance with an embodiment of the present technology. The impact reduction device 10 may include a pad 16 formed of two opposing layers, including a back layer 22 and front layer 20. The pad 16 may include one or more ribs 19 to stiffen the pad at its periphery and define the shape of the pad. Furthermore, each layer 20, 22 of the pad may define dimples 28 protruding in a direction toward the opposing layer. The impact reduction device 10 may optionally include a bladder 24 (shown in FIG. 3) disposed between the first and second layers of pad 16. In addition, impact reduction device 10 may include a pump 14 connected to the bladder 24. Pump 14 may inflate or deflate the bladder 24 by way of a conduit 18 connecting the pump 14 to the bladder 24.

Figure 3:
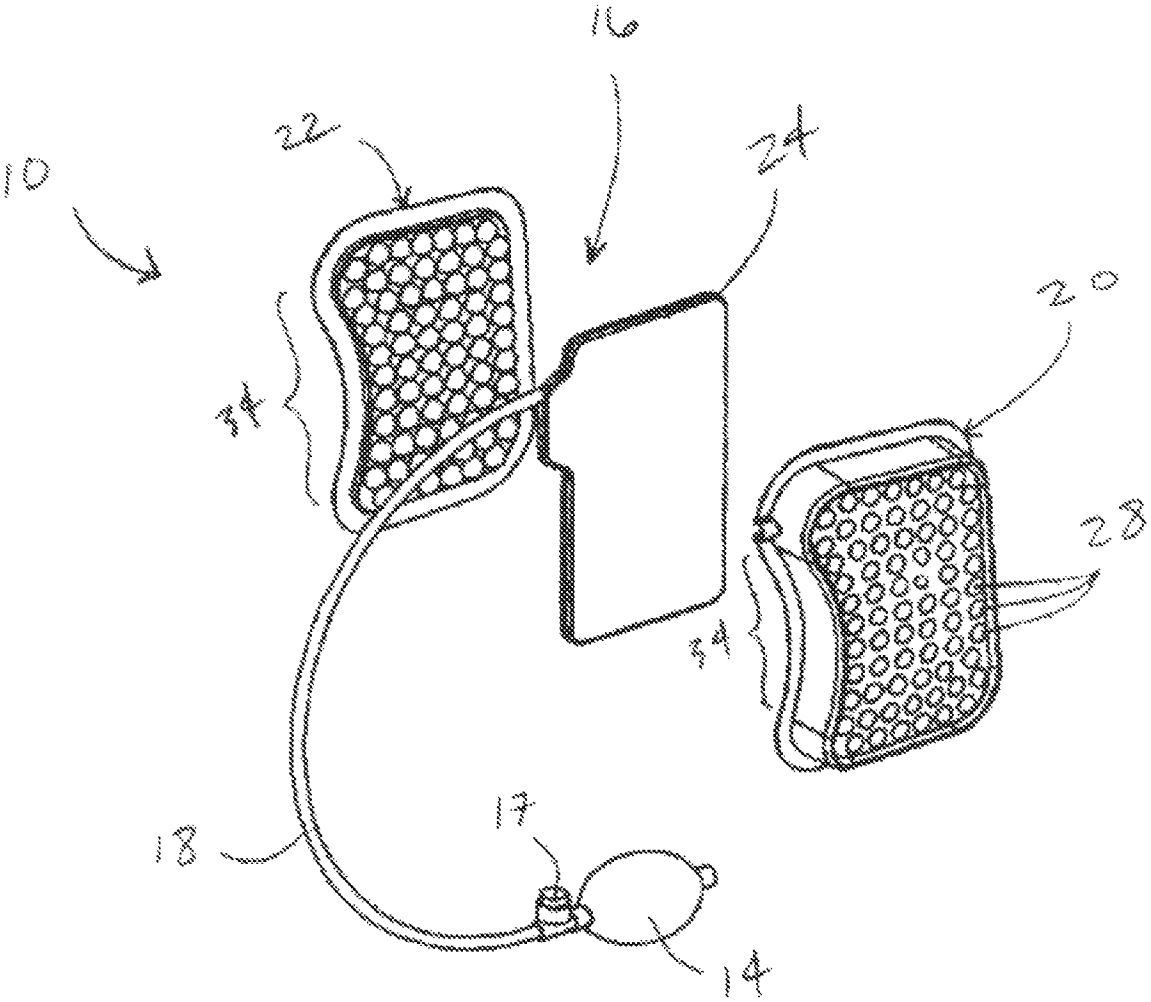
FIG. 3 is an exploded perspective view of the embodiment of FIGS. 1-2.
Figure 7:
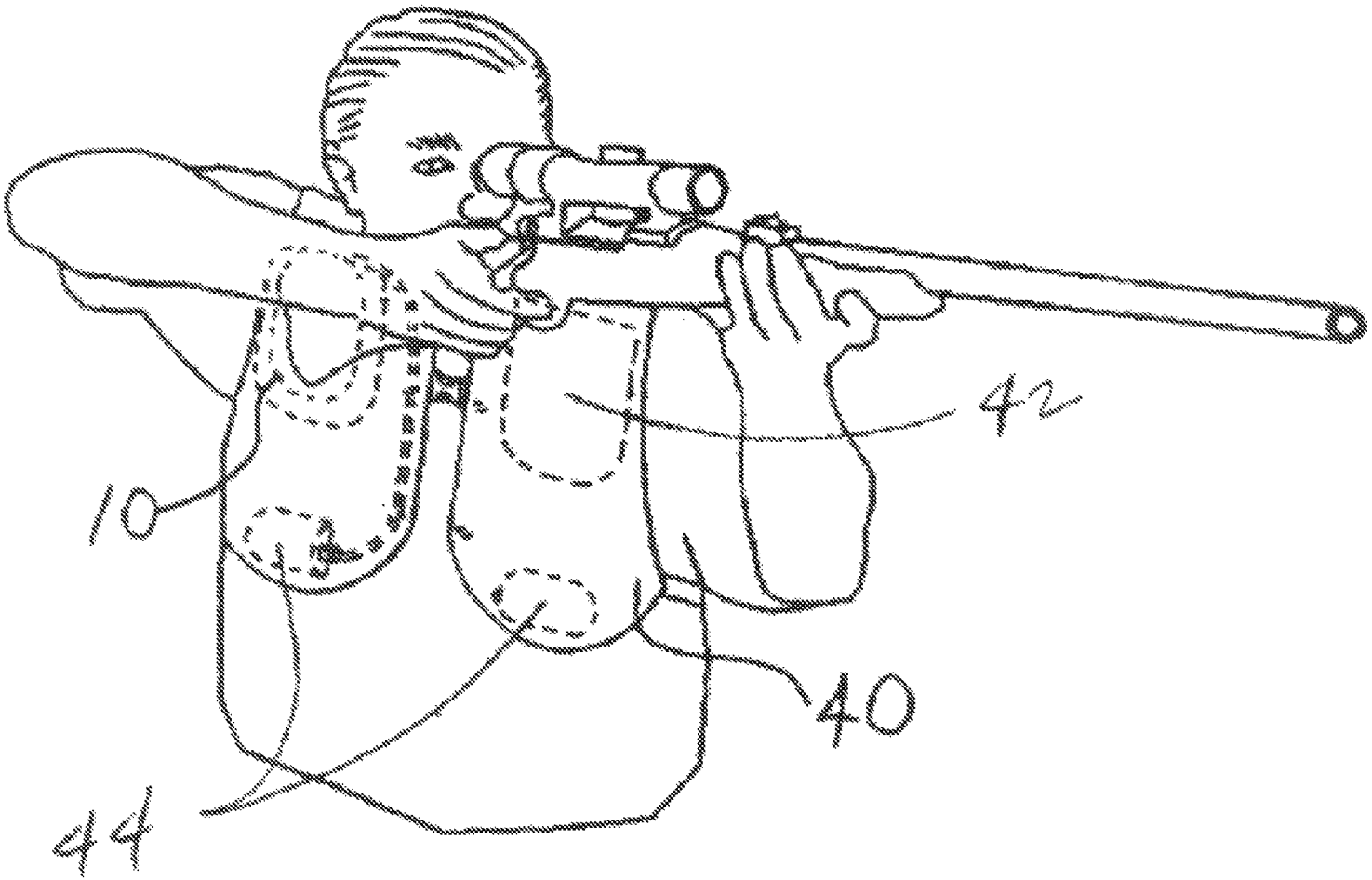
FIG. 7 shows the vest of FIG. 6 in use.
Figure 8:
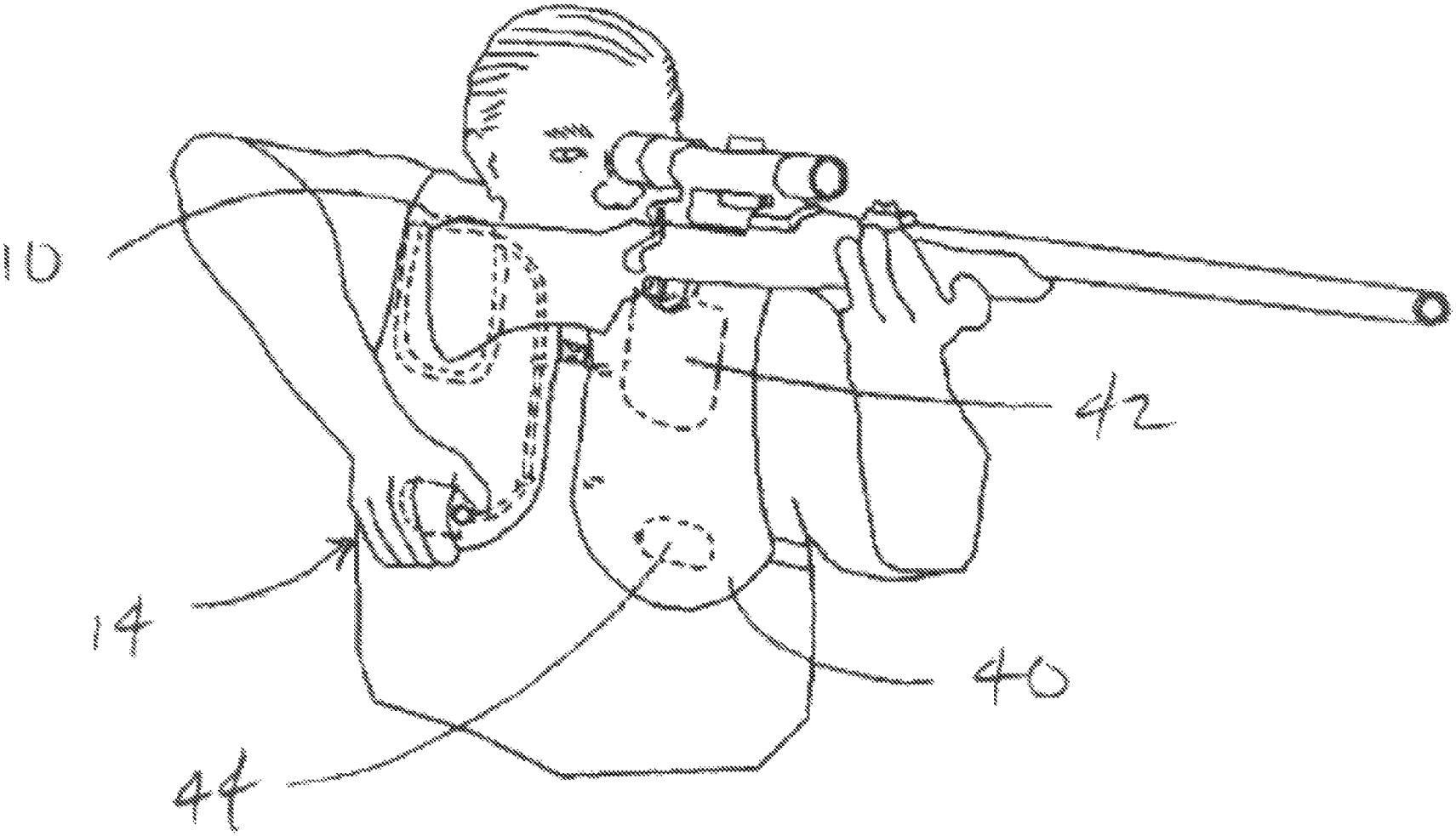
FIG. 8 shows the vest of FIG. 6, with the user adjusting the recoil suppression system by inflating the bladder connected to a manual pump.

The shape of the pad 16 will be predetermined by the intended placement of the pad on the human body. For example, in the case of a pad to protect against recoil of a rifle, the pad may likely be placed over the shoulder of a user, as shown in FIGS. 7 and 8. Thus, the pad may be shaped as shown in FIG. 3, with a curved contour 34 positioned to allow a user to turn his head and neck freely without impedance by the pad 16. Alternatively, such as where the pad will be used as an athletic pad, the pad may be shaped to conform to, for example, the head (for use in a helmet), neck, shoulder, ribs, spine, hip, thigh, knee, lower leg, upper arm, forearm, wrist, ankle, hand, and so forth. The shape of the pad may be determined by the application and the portion of the body that the pad is intended to protect.

Again referring to FIG. 3, there is shown an exploded view of the shock absorbing device 10, including layers 20 and 22 of the pad. Layer 22 may preferably be substantially flat and configured for placement proximate a user's body. In contrast, layer 20 may preferably be recessed so as to define an interior volume. As can be clearly seen, when layer 20 is superimposed over layer 22, the interior volume of layer 20 may receive a bladder 24, discussed below, so that when the pad 16 is assembled the bladder 24 is disposed between layers 20 and 22.

Preferably, the layers 20 and 22 may be joined at their peripheries, thereby enclosing the above discussed void between the layers. Such an enjoinment of the layers at their peripheries may preferably be accomplished by mechanical, thermal, or chemical means. Alternatively, the multi-layered pad 16 may be formed by a molding or other process. The edges of the molds may preferably be heat sealed, so there is no shifting of the layers relative to each other after they are joined.

Further preferably, the layers 20 and 22 of pad 16 may be composed of low density polyethylene materials or nanotubes. This low density polyethylene material may have a thickness of between 0.01 to 0.04 inch. Polyethylene is a desirable material for use in the present technology because upon receiving an impact force, polyethylene has the ability to compress and break down in order to absorb shock and dissipate energy. Moreover, after the impact force passes, polyethylene then has the ability to return to its pre-impact state. This resilience, or memory, enables a pad made from polyethylene to be reused multiple times without losing its effectiveness as an impact reduction pad. Alternative materials, such as coiled carbon nanotubes or composite carbon nanotubes possessing similar impact reduction qualities may also be used.

Figure 4:
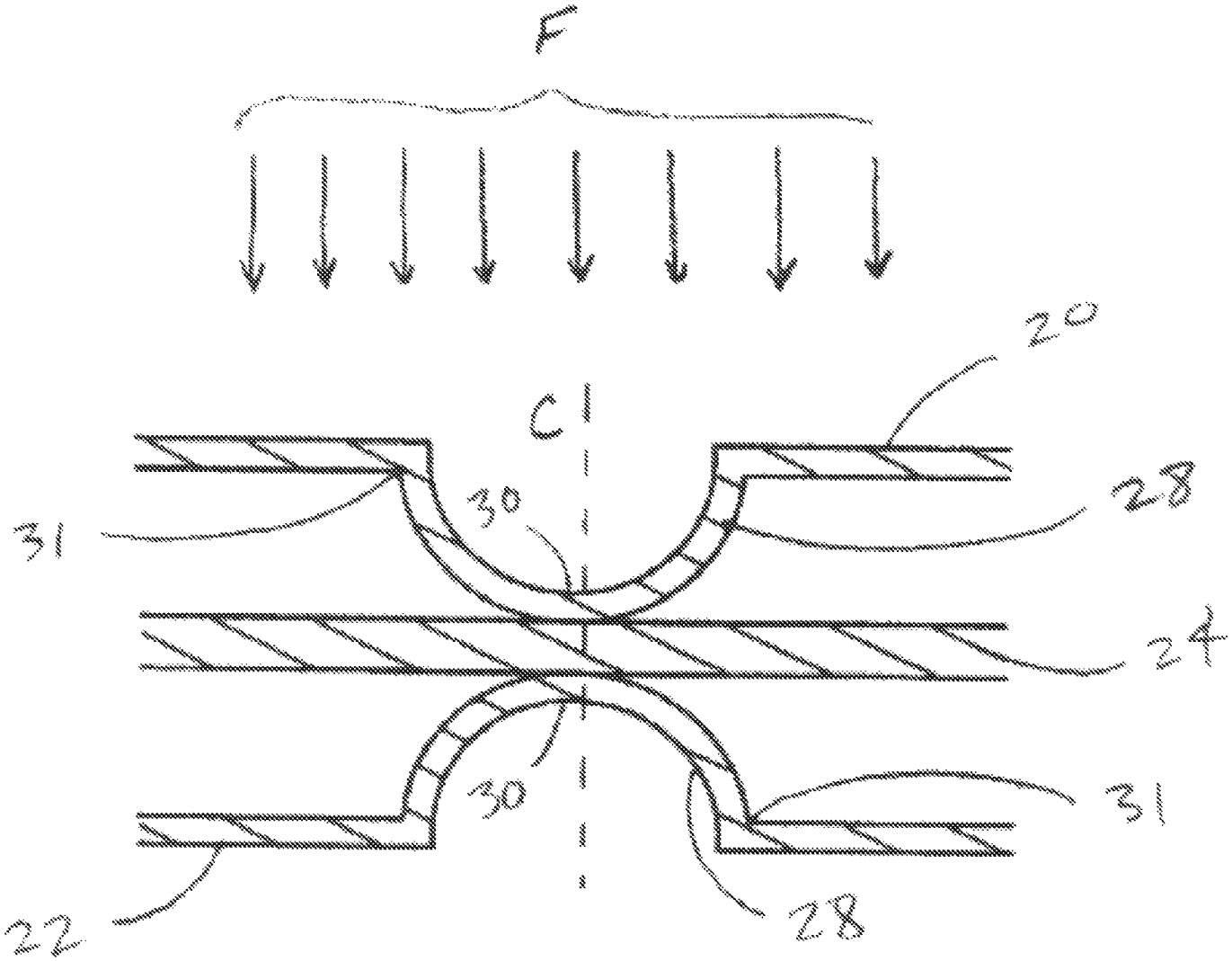
FIG. 4 is a cross sectional view of the embodiment of FIGS. 1-3 taken along line A-A of FIGS. 1 and 2.
Figure 5:
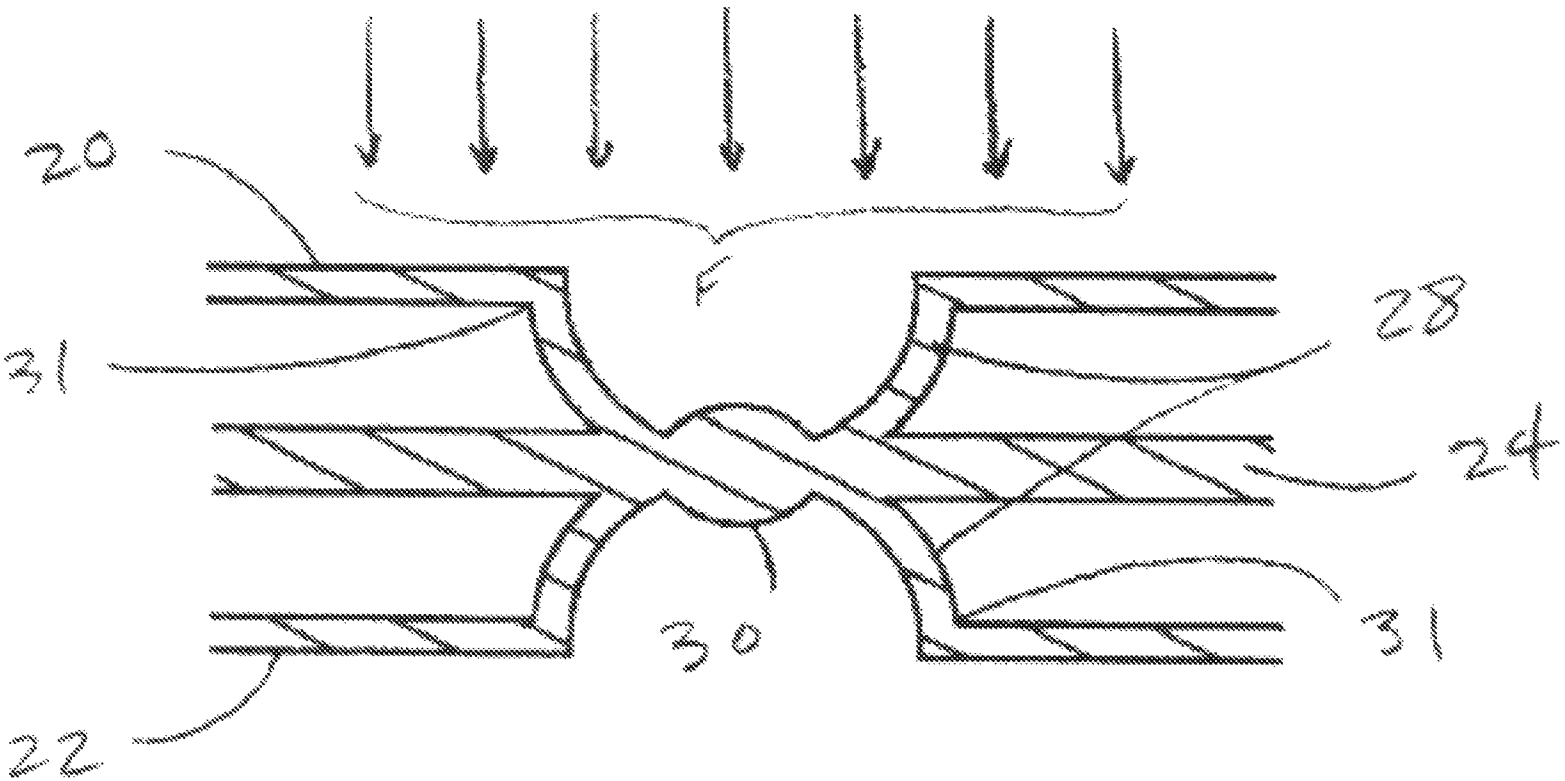
FIG. 5 is a cross sectional view of the embodiment of FIGS. 1-3 taken along line A-A of FIGS. 1 and 2 upon application of a force F to the pad.

FIGS. 4 and 5 show cross-sectional views of the dimples 28 of the pads of the present technology. FIG. 4 shows layers 20 and 22 in an assembled state with bladder 24 disposed therebetween. In the drawing, bladder 24 is shown in its deflated form. The dimples 28 of each layer may be configured to extend inwardly toward the opposing layer of the pad. The apices remain in alignment during use of the pad because the edges of the pads are joined using a heat seal, as discussed above. Each dimple 28 has an apex 30 and a base 31. As an impact force F is applied to the pad, the layers 20 and 22 of the pad are pressed together, thereby bringing the apices of opposing dimples 28 together. Force F is directed parallel to the center axis C of the dimples. As force is applied to the apex of each dimple 28, the energy exerted by force F is dissipated around the circumference to the base of each dimple. From the base, the energy is dispersed radially 360 degrees along the plane of the layer within which the dimple is formed. Thus, the energy of the impact force is directed away from the user's body along the plane defined by the surface of the pad, and the body is protected.

In addition to the above, the dimples 28 dissipate the energy of an associated impact force by collapsing. That is, at some point during application of impact force F, the magnitude of the force, and the amount of kinetic energy imposed upon the pad thereby, may be large enough to collapse or partially collapse the dimples as shown in FIG. 5. When this occurs, the energy entering the pad is further dissipated in the form of elastic energy, heat, sound, etc. Thus, the dimples 28 serve to dissipate energy and protect the user of the pad in more than one way. Furthermore, because the dimples 28 are formed of polyethylene, they are elastic and resilient, and will return to their normal shape after removal of the impact force.

As discussed above, and shown in FIG. 3, bladder 24 may be disposed between layers 20 and 22 of pad 16. The bladder 24 may preferably include walls enclosing a void, like a balloon, although it is not intended to be limited to this structure. For example, the bladder could alternatively be an inflatable foam or other material capable of retaining air or other fluid and whose volume is adjustable depending on the amount of air or other fluid retained. In use, bladder 24 may substantially fill the interior volume between back layer 22 and front layer 20. Bladder 24 may be inflated with a fluid, preferably air, to a desired level. The fluid-filled bladder may then provide additional cushion or protection against impact forces by absorbing impact energy before it reaches a user's body. When the inflated bladder 24 is used along with the dimpled layers of the pad, the energy dissipation abilities of each component work together to provide a high level of protection that could not be achieved by the use of any one component by itself.

Bladder 24 may be inflated or deflated by a detachable pump 14, shown in FIGS. 1-3. The pump 14 may be a manual pump as shown in the drawings. Alternatively, the pump 14 may be powered by an outside source such as, for example, an electrical, aerosol, or pneumatic source. In the embodiment shown in FIGS. 1-3, the pump 14 is connected to the bladder 24 via a conduit 18. Conduit 18 may be any suitable conduit for carrying air or other fluids. In addition, a valve 17 may be inserted between the pump 14 and bladder 24 to maintain the fluid pressure in the bladder, to provide an indication of the pressure contained in the system, or to allow the user to relieve pressure by releasing air.

One aspect of the present technology includes the method of using the pads 16 to protect the human body from potentially injury-causing impact. In the case of marksmanship, the pads 16 of the shock absorbing device 10 may preferably cover the front of the shoulder of a marksman as shown in FIGS. 7 and 8. If the marksman is firing a rifle, the pads 16 may be positioned such that the butt of the rifle contacts the pads. Thus, when the rifle is fired and recoils, the impact force from the butt of the rifle enters directly into the device 10 and the kinetic energy of the impact force is dissipated by the pads and the bladder of the device.

Figure 6:
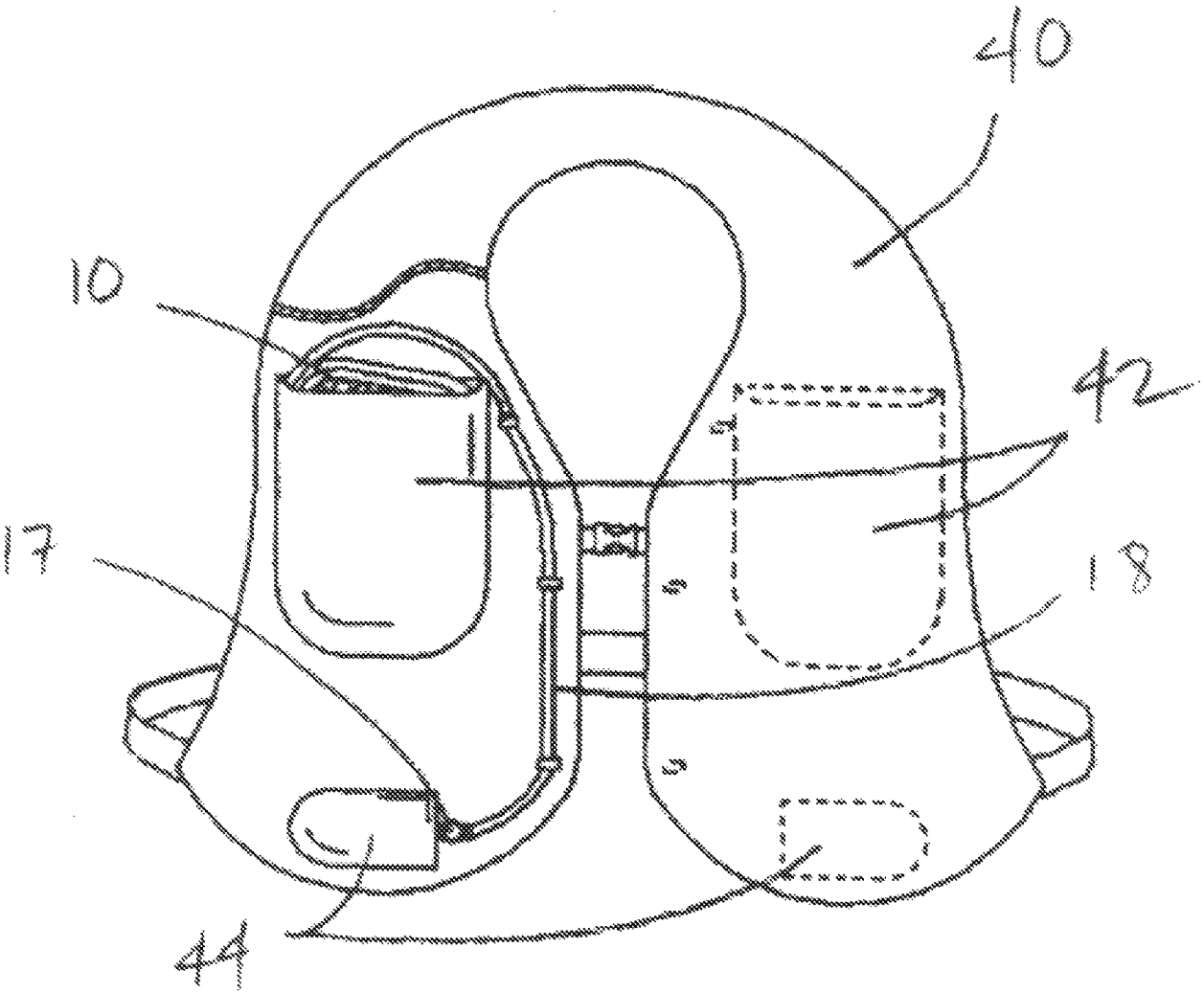
FIG. 6 is a front view of a shooting vest with an embodiment of the present invention incorporated therein for recoil suppression.

Referring to FIGS. 6-8, device 10 may be used with a vest 40 or other piece of clothing. The vest 40 may include pockets 42 and 44 for supporting the pads 16 and the pump 14 of the device 10 in a desired location. The pockets 42 and 44 may be positioned on the right or the left side of the vest 40 in order to accommodate users having differing dexterity. In addition, positioning the pump 14 of the device 10 in a lower pocket 44 of the vest 40, as shown in FIG. 8, is ergonomically conducive to adjusting the pressure in the bladder 24 by providing the user's hand easy access to the pump 14.

Figure 9:
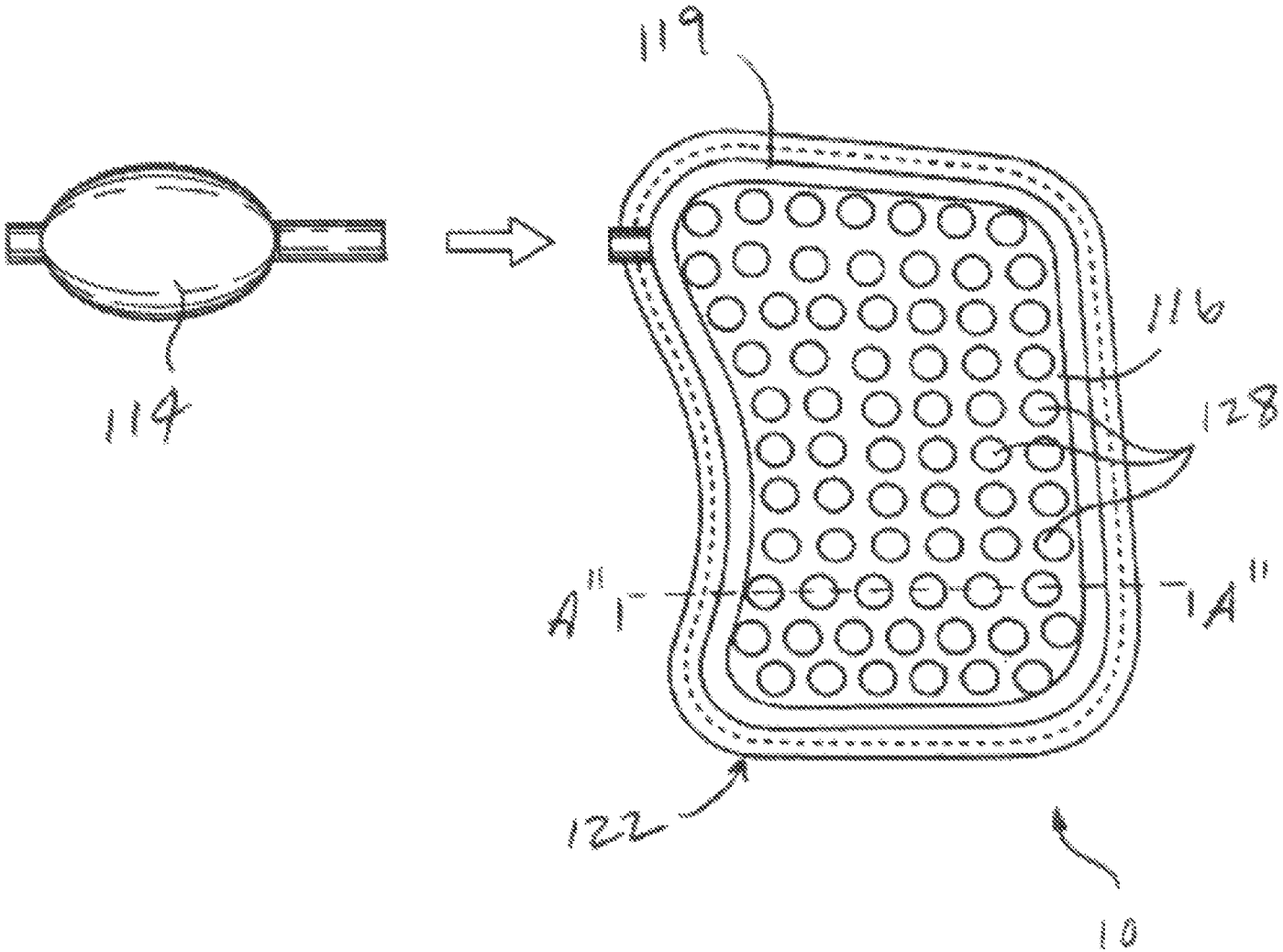
FIG. 9 is a front, perspective view of an alternative embodiment of the present invention.
Figure 10:
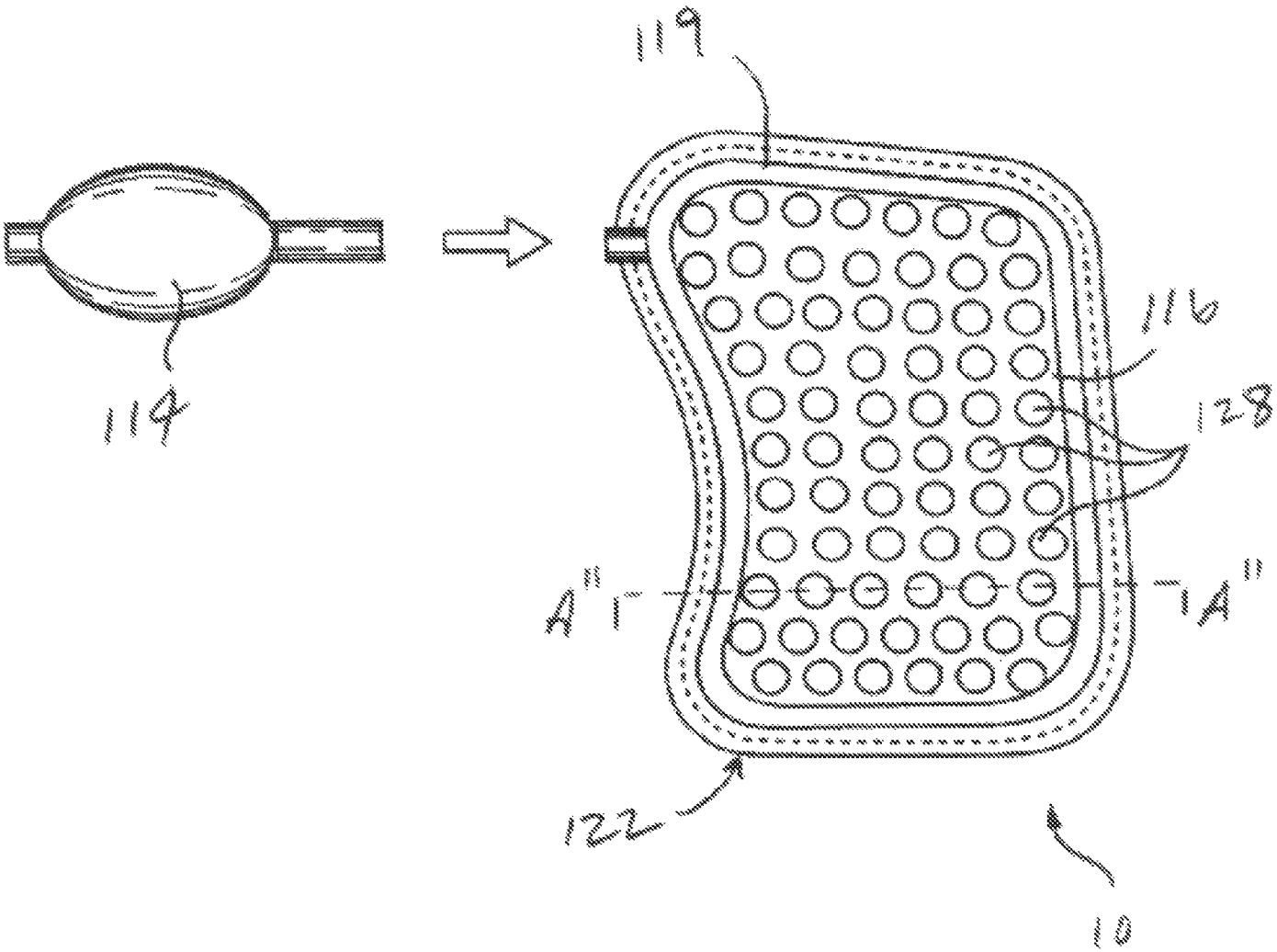
FIG. 10 is a back perspective view of an embodiment of the present invention.
Figure 11:
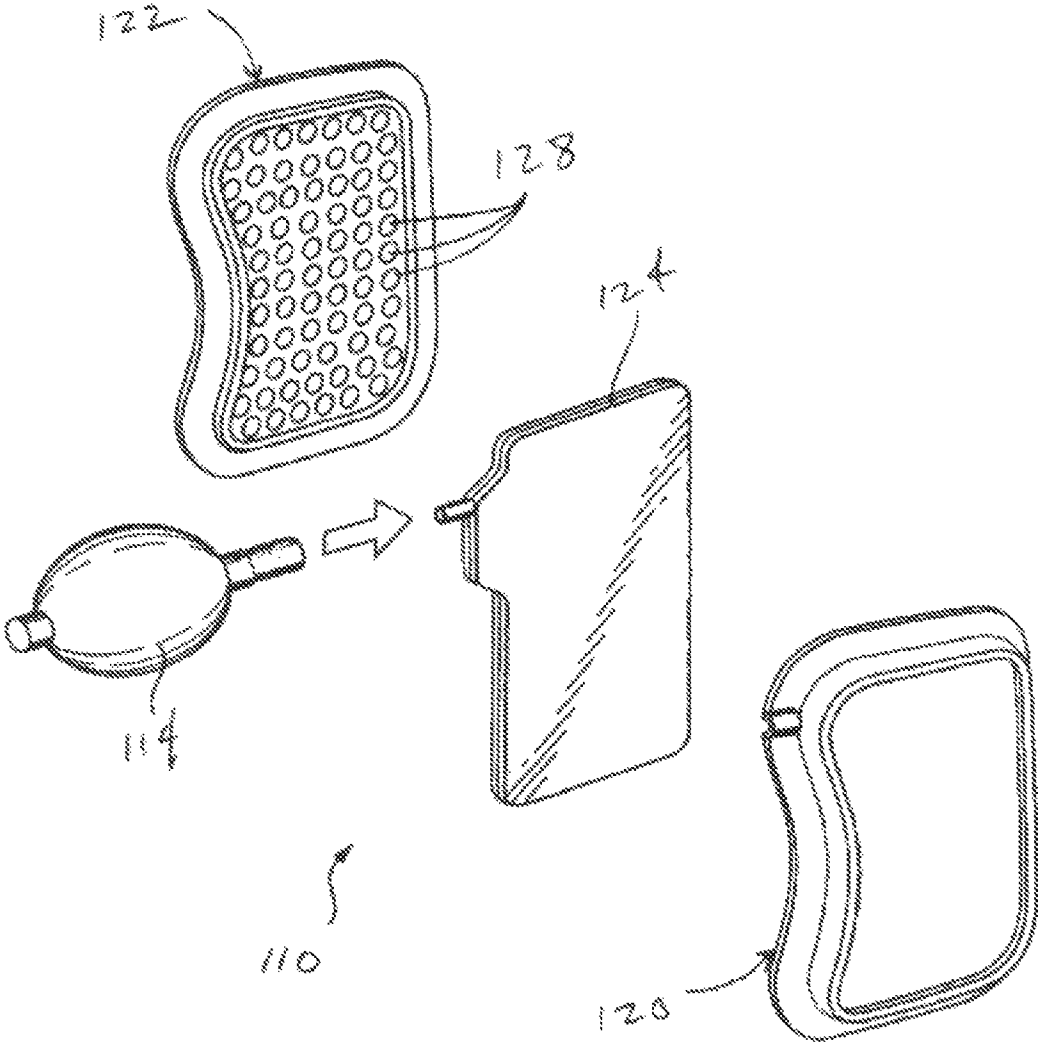
FIG. 11 is an exploded perspective view of the embodiment of FIG. 9.

Although use of the shock absorbing device of the present technology has been discussed with regard to use in the specific application of marksmanship, another aspect of the technology provides shock absorbing devices for use in other applications, such as contact sports, gravity game sports, and other impact sports. For example, there is shown in FIGS. 9-11 a shock absorbing device 110 according to the present technology having a pad 116 formed of two opposing layers 120 and 122. In a preferred embodiment, the outer layer 120 may be formed of a low density polyethylene material while the inner layer 122 may also be formed of a low density polyethylene material. The pad 116 may include one or more ribs 119 to stiffen the pad 116 at its periphery and define the shape of the pad. Furthermore, one or more of layers 120, 122 of the pad 116 may define dimples 128 protruding in a direction toward the opposing layer. The shock absorbing device 110 may further include a bladder 124 (shown in FIG. 11) disposed between the layers of pad 116. In addition, shock absorbing device 110 may include a pump 114 configured for removable attachment to the bladder 124.

Figure 12:
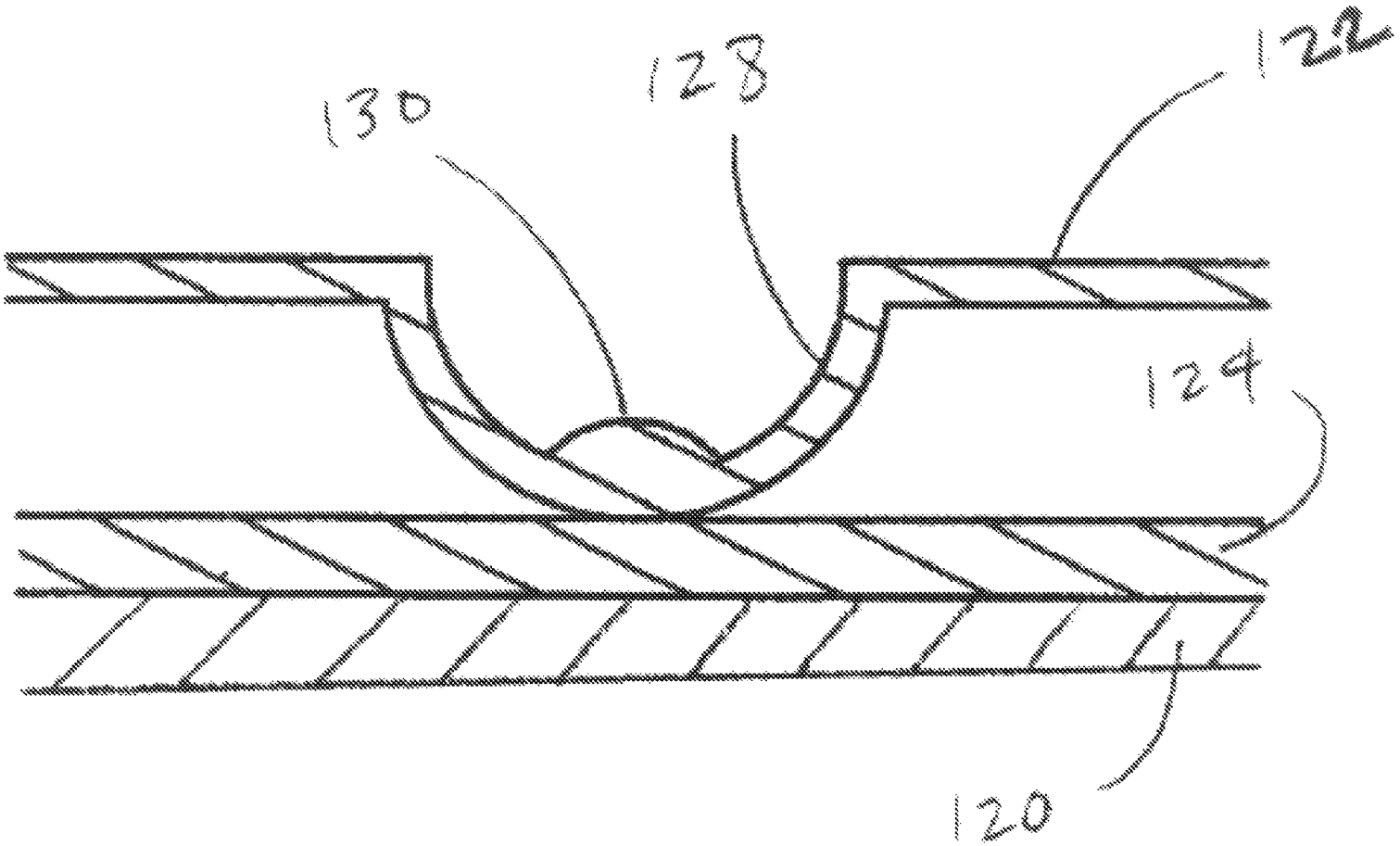
FIG. 12 is a cross-sectional view of the embodiment of FIGS. 9 and 11 taken along line A'-A' of FIG. 9.

The pad of the present embodiment is well suited for use as an athletic pad because of its thin profile. For example, in the embodiment shown in FIGS. 9 and 11, layer 122 of pad 116 defines dimples while layer 120 does not. Such an arrangement is further shown in the cross sectional view of FIG. 12. With this arrangement, the dimples 128 of layer 122 may still provide the necessary structure to aid in energy dissipation, behaving in the same way as described above, while at the same time the overall thickness of the device may be reduced. Such a reduction of thickness of the impact reduction device allows great flexibility and range of movement for an athlete using the device. Such a feature is beneficial to athletes competing, for example, in contact sports such as American football, soccer, and hockey, among others. Note that the thickness of the material in a layer such as 122 does not need to remain constant. There can also be thicker sections, such as that shown at the dimple apex 130 to further refine the response of the pad to various forces.

Figure 13:
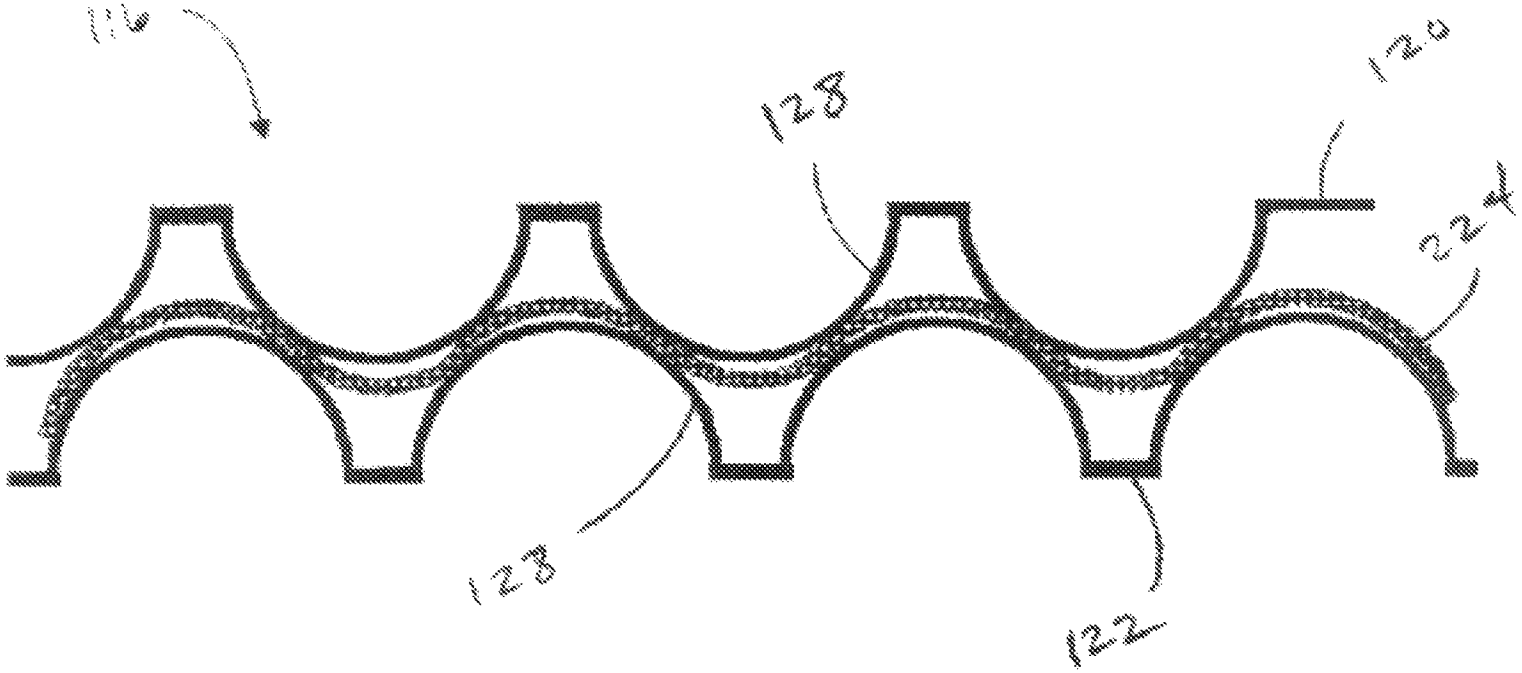
FIG. 13 is a cross-sectional view of an alternative embodiment of the present invention taken along line A"-A" of FIG. 10.

Similarly, as shown in FIG. 13, both layers 122 and 120 of pad 116 may define dimples that are offset from one another. In this arrangement the dimples 128 of layer 120 are aligned with the voids between the dimples of layer 122. Such an arrangement may provide an increased number of dimples as compared with the arrangement shown in FIGS. 9 and 11, while simultaneously maintaining a thin profile suitable for use in athletic equipment. There can also be an interposed layer 224, which can be a bladder.

As shown in FIGS. 9-11, another distinguishing feature of the present embodiment is the pump configuration. In the case of athletic pads, the pump 114 may be directly attachable to the bladder 124 without the use of a conduit. Furthermore, the pump 114 may be detachable so that when the bladder 124 has been properly inflated the pump can be removed and will not interfere with the movement of the athlete thereafter. Upon removal of the pump 114, an interior valve (not shown) within the bladder 124 will close, thereby maintaining a desired volume of air within the bladder. Air may be released from the bladder by adjusting or squeezing the valve in such a way to open the valve to the flow of air.

Figure 14A:
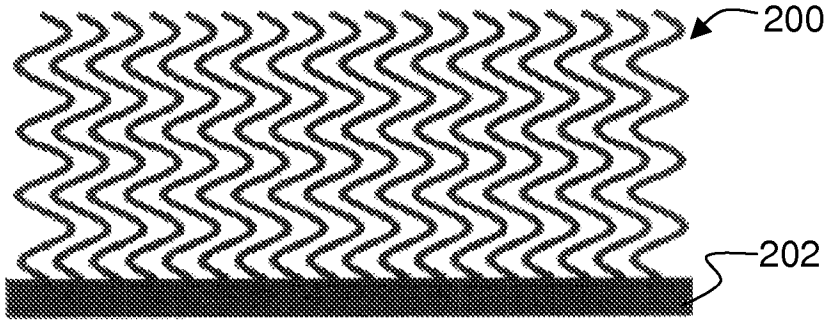
FIGS. 14*a*-14*d* are schematic diagrams of arrangements of the nanotubes of embodiments of the present invention.
Figure 14B:
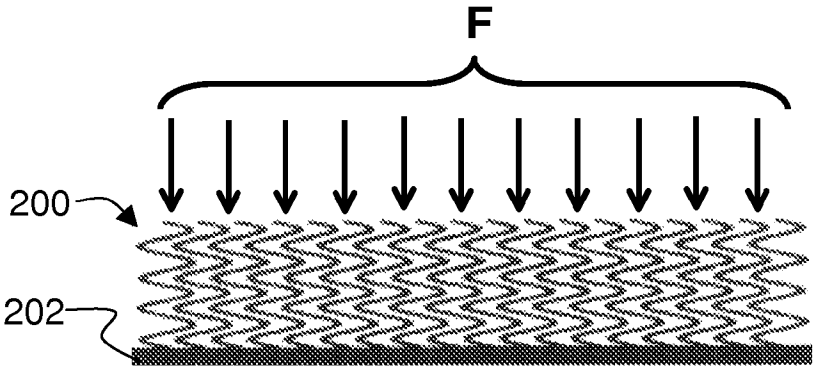
Figure 14C:
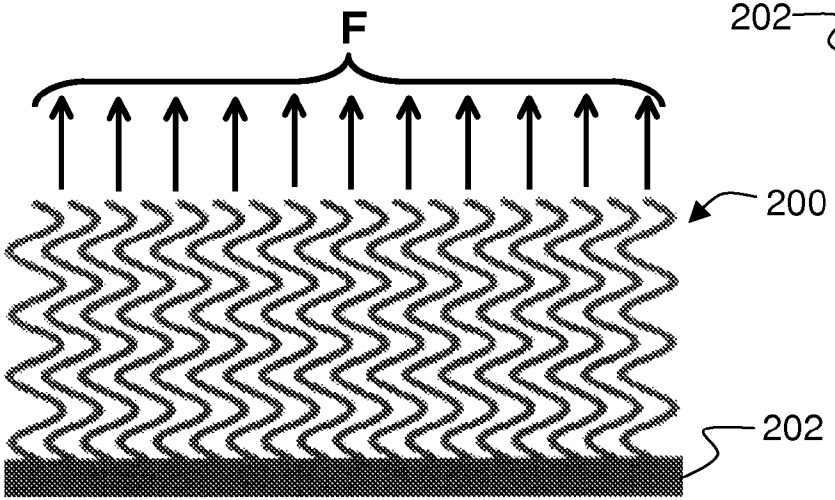
Figure 14D:
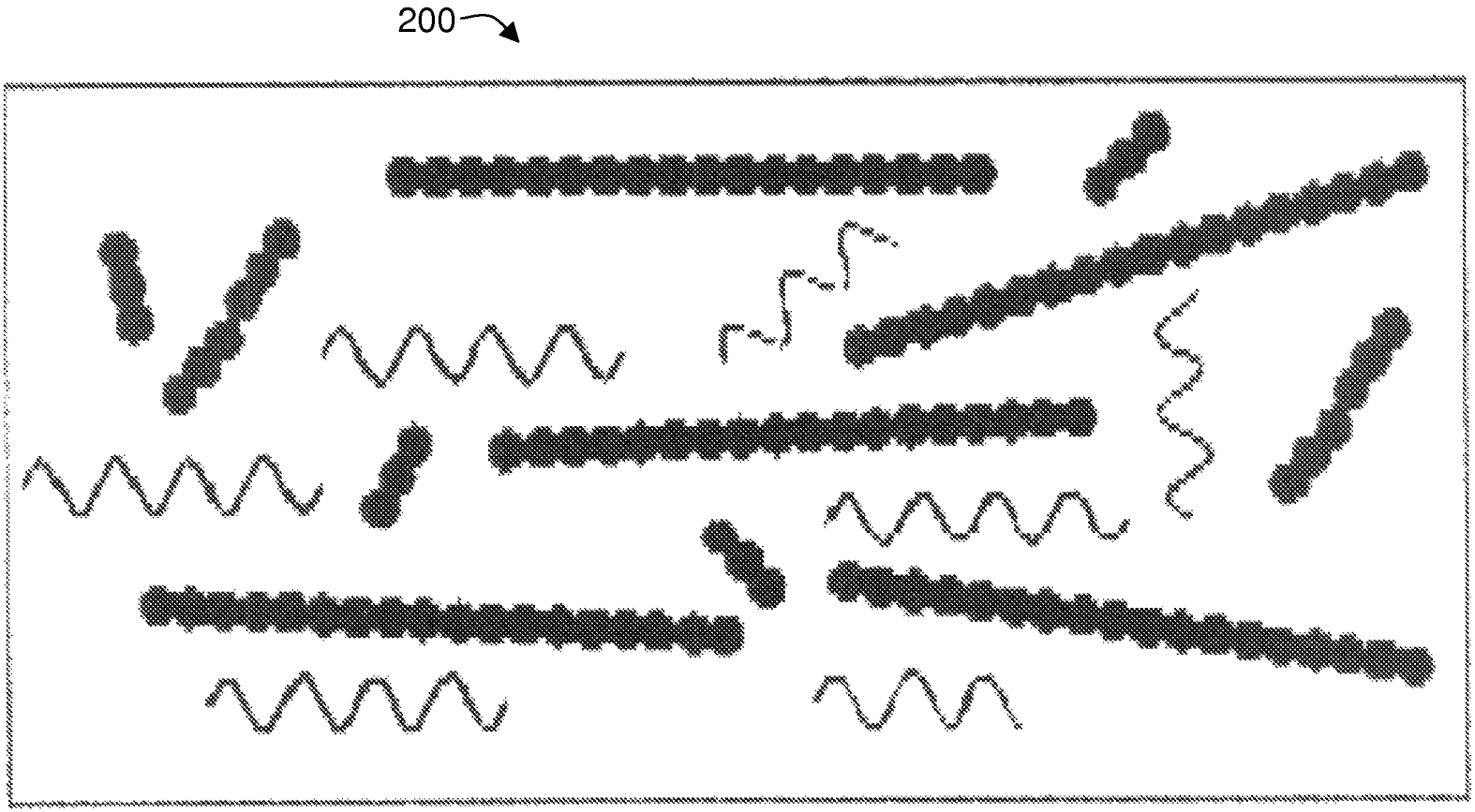

Referring to FIGS. **14*a*-14*d*, there is shown a forest of carbon nanotubes 200 as may be used in an embodiment of the present technology. The nanotubes (i.e. nanometer-scale carbon material in which the individual carbon atoms are bonded together in a tubular configuration) may be coiled carbon nanotubes, shown in FIGS. 14*a*-14*c*, or composite carbon nanotubes, as shown in FIG. 14*d*, and may be attached to at least a portion of the impact reduction device to further enhance the shock absorbing capabilities of the device. Similar to the polyethylene described above, these nanotubes have the ability to lessen the impact to the human body by compressing upon application of a force F, as shown in FIG. 14*b*, and then resuming their pre-impact shape after the force is removed, as shown in FIG. 14*c*. A thin layer of the nanotube material may cover one or both sides of the polyethylene material 202** to enhance the impact absorption capabilities thereof. Alternatively, the nanotube material may replace the polyethylene material. Furthermore, the nanotube material may be layered over the bladder to prevent puncture. Other materials that may be used in embodiments of the present invention can include:

silicone carbide;
boron carbide;
amorphous boron;
hafnium carbine;
tantalum carbide;
tungsten carbide;
magnesium diboride;
glassy carbon;
diamond-like carbon;
single-crystal tungsten;
boron nitride;
titanium diboride;
hafnium diboride;
lanthanum hexaboride;
cerium hexaboride;
molybdenum carbide;

tungsten disulfide;
polyurethane;
polyvinyl;
nylon;
an aramid material such as kevlar;
or any organic or inorganic material.

Figure 15:
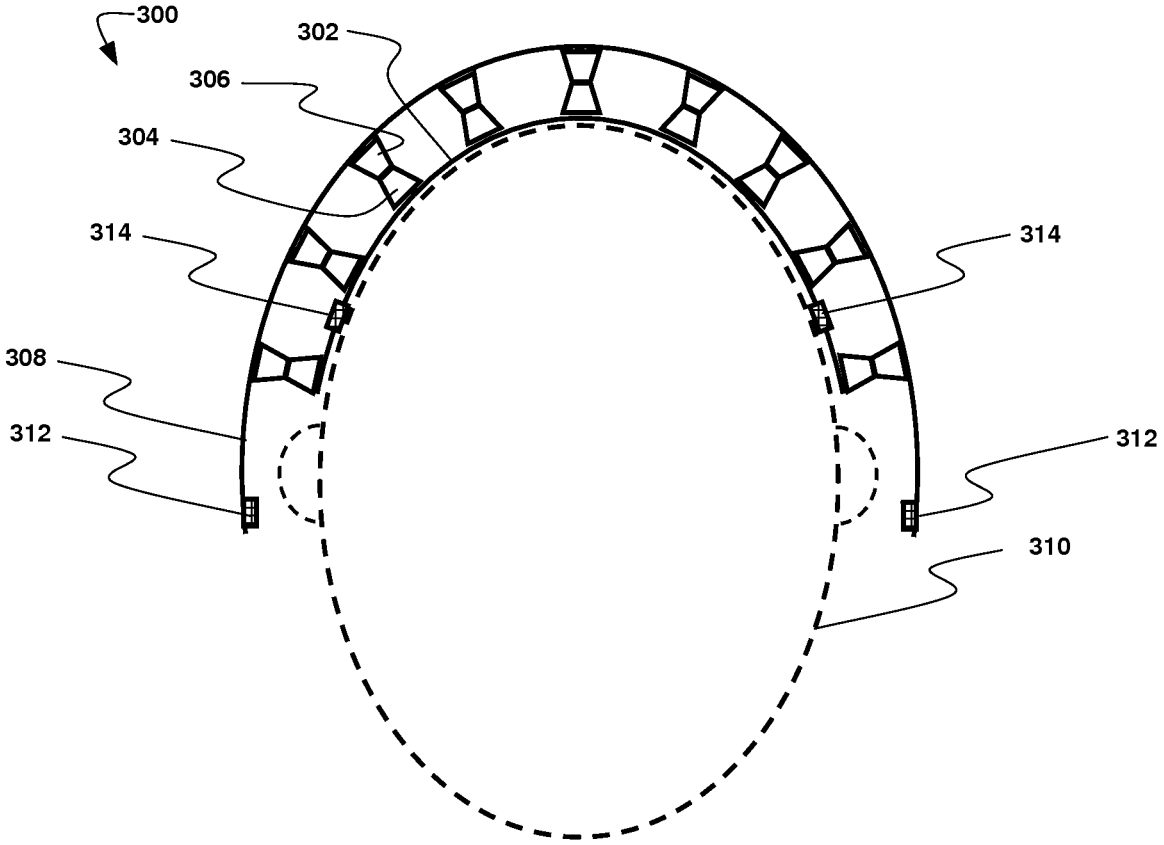
FIG. 15 is a cross-sectional view of a four-layer impact reduction system configured as a helmet.

Referring to FIG. 15, a cross-sectional view of a four-layer impact reduction system configured as a helmet, is shown at 300. In this embodiment, the helmet-shaped pad 300 is located on a person's head, shown at 310. The helmet-shaped pad is composed of: a body-conforming layer 302 located closest to the person's body; an impact distribution layer 308 located furthest from the person's body; and two layers of elastically resilient impressions, shown at 304 and 306, which are located between the body-conforming layer 302 and the impact-distribution layer 308. In this configuration, the two layers with elastically resilient impressions, 304 and 306, are similar in structure, materials, and characteristics as layer 20 and layer 22 that were shown in FIGS. 1, 2, 3, 4, and 5 and layer 120 and 122 that were shown in FIGS. 9, 10, 11, 12, and 13. These layers with elastically resilient impressions could also be made of carbon fiber or nanometer-scale carbon nanotubes as illustrated at 200 in FIGS. 14*a*, 14*b*, 14*c*, and 14*d*. The body conforming layer 302 is equivalent to the inner layer of the pocket 42 shown in FIGS. 6, 7, and 8. The impact reduction layer 308 is equivalent to the outer layer of the pocket 42 shown in FIGS. 6, 7, and 8, but has one additional distinguishing characteristic in that that the impact distribution layer 308 is more rigid than the body conforming layer to help distribute an external impact over an area.

Further referring to FIG. 15, the configuration of the impact reduction system shown includes sensors, shown at 312 and 314. The sensors shown at 312 are attached to the impact-distribution layer 308. The sensors shown at 314 are proximate to the wearer's body 310. These sensors 312 and 314 could also be attached to the wearer's body 310. The sensors 312 and 314 could be shielded from the wearer's body for safety reasons. The sensors 312 and 314 can be used to detect a variety of parameters, examples of which can include:

- detecting a rotational or angular acceleration, which might be useful in determining characteristics such as, the timing of an impact, the magnitude of an impact, the direction of an impact, or the effectiveness of the impact reduction system in reducing the severity of the impact;
- detecting an orientation, which might be useful in determining a characteristic such as the position of a person's body part at the time of an impact;
- detecting a velocity, which might useful in determining a characteristics such as the velocity at which an impact occurred;
- detecting a parameter of another object in the vicinity, an example might be detecting the location and velocity of other impact pads (such as helmets) being worn by other persons in the vicinity, which might be useful in identifying an impending impact;
- detecting a signal from another object in the vicinity, an example might be detecting an alarm signal coming from a device on another soldier in the vicinity; and/or
- detecting a biometric parameter associated with the wearer. Examples of biometric parameters might include blood pressure, pulse, body temperature, oxygen saturation, electro-cardio activity, brain activity, and neural activity.

The sensors shown in FIG. 15 can be connected to a processor that is part of the impact reduction system. This processor can include a memory element to store sensor data. This stored sensor data can be used for data logging, which can facilitate evidence-driven management of the sensing and data collection process, whereby data derived from the sensors could be used to repair, modify, or alter the responsiveness of a sensor or to alter the responsiveness of a sensor and/or alter the data being recorded from a sensor or to alter the frequency at which data is being recorded from a sensor. The sensor data can also be transmitted and this transmission can be in the form of a wireless protocol such as WiFi, Bluetooth, Zigbee (and related IEEE 802.15.4 and XBee), a cellphone signal, or any other wireless protocol capable of being understood by someone skilled in the art. Sensor data can also be used to produce an alarm signal capable of being understood by a human, examples of which might include an audio alarm, a visual flashing red light, or a vibration or other tactile signal. The sensors 312 and 314 can be powered by a battery, by a generator, or by an external power source that sends its power over a wired or wireless method.

The sensors 312 and 314 shown in FIG. 15 can also be connected to an impact mitigation device such as an air bag. This air bag could be located outside of the impact-distribution layer 308. Thus, an impact-detecting or impact-anticipating sensor could issue a signal to the airbag system that causes the airbag to deploy, cushioning the impact and thereby reducing the magnitude of the impact and bodily damage to the person wearing the impact reduction system.

Figure 16A:
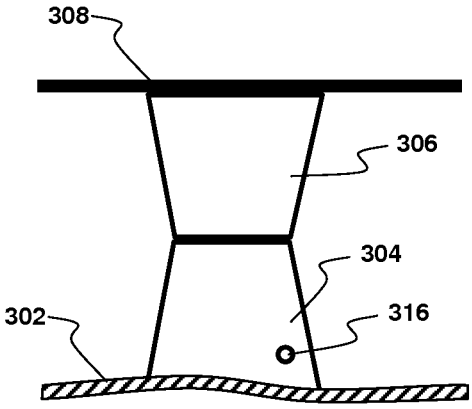
FIG. 16*a*-16*c* are detailed views of two dimple layers in a serial configuration interacting with each other.
Figure 16B:
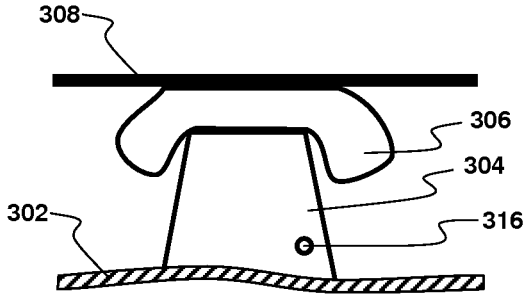
Figure 16C:
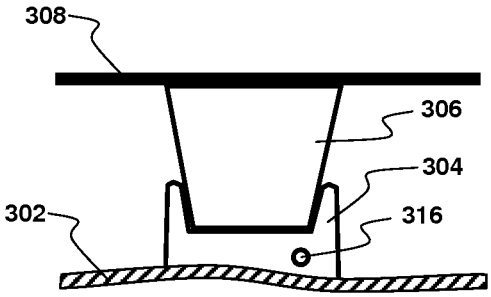

Referring to FIGS. 16*a*, 16*b*, and 16*c*, detailed views of elements of an embodiment of the four-layer impact reduction system of FIG. 15 is shown, including the body conforming layer 302, an elastically-resilient impression in a second layer 304, an elastically-resilient impression in a third layer 306, and an impact distribution layer 308. In the embodiments shown in FIGS. 16*a*, 16*b*, and 16*c*, the two layers with dimples 304 and 306 are in a series relationship (i.e. an aligned contact) in that the same force that passes through the second layer 304 is transmitted to the third layer 306 and the total compression is the sum of the compression of the second layer 304 and the compression of the third layer 306. In the embodiment shown in FIGS. 16*a*, 16*b*, and 16*c* the dimple in the third layer 306 comprises a sealed air chamber and the dimple in the second layer 304 comprises an orifice 316 that allows air (or any other gas or liquid) to bleed out of the dimple, providing a damping or "shock absorber" feature whose resistance to compression (or tension) is velocity sensitive. Note that the sealed air chamber shown in the third layer 306 could be implemented in a variety of ways examples of which include using a permanently sealed chamber, using a bladder that can be filled or emptied as desired through a closeable valve, and/or using a closed cell foam. Note also that the elements with damping in them can have a single orifice 316 or multiple orifices, and at an extreme the damping could comprise an open-cell foam. FIG. 16*a* shows the system in a relaxed state in which there is no force compressing the impact distribution layer 308 towards the body conforming layer 302. FIG. 16*b* shows an exaggerated example what happens as a result of a high speed acceleration of the distribution layer 308 towards the body conforming layer as the bulk of the deflection is taken by the sealed dimple of the third layer 306 because there is not enough time to bleed the air through the orifice 316 in the dimple in the second layer 304. FIG. 16*c* shows an exaggerated exampled of what happens as a result of a low speed acceleration of the distribution layer 308 towards the body conforming layer 302 as the bulk of the deflection is taken by the unsealed dimple of the second layer 304 because there is time to bleed the air through the orifice 316, and the sealed dimple in the third layer is altered less because the bulk of the deflection occurs as a result of air bleeding through the orifice 316 from the dimple in the second layer 304.

Figure 17A:
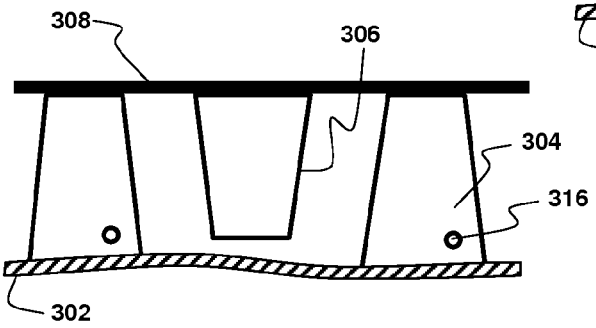
FIG. 17*a*-17*c* are detailed views of two dimple layers in a parallel configuration interacting with each other.
Figure 17B:
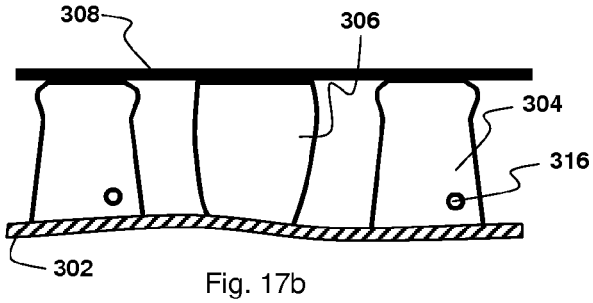
Figure 17C:
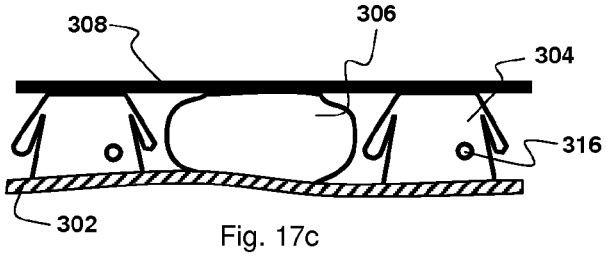

Referring to FIGS. 17*a*, 17*b*, and 17*c*, detailed views of elements of an embodiment of the four-layer impact reduction system of FIG. 15 is shown, including the body conforming layer 302, two elastically-resilient impressions in a second layer 304, an elastically-resilient impression in a third layer 306, and an impact distribution layer 308. In the embodiments shown in FIGS. 17*a*, 17*b*, and 17*c*, the two layers with dimples 304 and 306 are in a parallel relationship (i.e. an offset contact) in that an equivalent deflection occurs for the second layer 304 and third layer and the total compressive force being transmitted is the sum of the force in the second layer 304 and the force in the third layer 306. In the embodiment shown in FIGS. 17*a*, 17*b*, and 17*c* the dimple in the third layer 306 comprises a sealed air chamber and the dimples in the second layer 304 comprise orifices 316 that allow air to bleed out of the dimples, providing a damping feature. FIG. 17*a* shows the system in a relaxed state in which there is no force compressing the impact distribution layer 308 towards the body conforming layer 302. FIG. 17*b* shows an exaggerated example what happens as a result of a high speed acceleration of the distribution layer 308 towards the body conforming layer as the bulk of the compression is resisted by the dimples in the second layer 304 because there is not enough time to bleed the air through the orifices 316. FIG. 16*c* shows an exaggerated exampled of what happens as a result of a low speed acceleration of the distribution layer 308 towards the body conforming layer 302 as the bulk of the compressive force is resisted by the sealed dimple of the third layer 306 because there is time to bleed the air through the orifices 316 of the dimples in the second layer 304.

Further referring to FIGS. 15-17*c*, the second layer 304 and third layer 306 can be designed to have different resistance to deflection in a direction perpendicular to the surfaces of the body conforming layer 302 and the impact distribution layer 308 than their resistance to deflection parallel to the surfaces of the body conforming layer 302 and impact distribution layer 308, whereby the rotational resistance of the helmet shown as 300 in FIG. 15 might be different than the resistance to impacts perpendicular to the shell of the helmet 308 in FIG. 15. Note also that the force deflection characteristics can be different for different dimples in the system. Thus, the impact reduction system can comprise dimples that have force-displacement relationships that vary:

as a function of direction;
as a function of speed;
as a function of position;
as a function of location; and/or
as a function of rotation versus translation.

Although the invention herein has been described with reference to particular embodiments, it is to be understood that these embodiments are merely illustrative of the principles and applications of the present invention. For example, the present invention may be used to protect workers in an industrial setting, at a construction site, etc. In order to accomplish this, the device of the present invention may, for example, be included in construction helmets, knee pads, or standing pads. It is therefore to be understood that numerous modifications may be made to the illustrative embodiments and that other arrangements may be devised without departing from the spirit and scope of the present invention as defined by the appended claims.

A number of variations and modifications of the disclosed embodiments can also be used. The principles described here can also be used for in applications other than sports. While the principles of the disclosure have been described above in connection with specific apparatuses and methods, it is to be clearly understood that this description is made only by way of example and not as limitation on the scope of the disclosure.

What is claimed is:

1. A wearable impact reduction device comprising a first layer, a second layer, a third layer, and a fourth layer wherein:

the first layer is located closest to the wearer's body;
the first layer comprises a flexible material configured to conform to the shape of a user's body;
the fourth layer is located furthest from the wearer's body;
the fourth layer is more rigid than the first layer whereby the fourth layer can distribute an external impact over a region;
the second layer is placed between the first layer and the third layer;
the third layer is placed between the second layer and the fourth layer;
the second layer comprises an elastically-deformable material having at least one resilient impression arranged and configured to at least partially compress upon application of a force and to return elastically to its original shape upon removal of the force;
the third layer comprises an elastically-deformable material having at least one resilient impression arranged and configured:
to contact and transmit a force to said resilient impression in the second layer;
to at least partially compress upon application of a force; and
to return to its original shape upon removal of a force.

2. The device of claim 1 further comprising a sensor responsive to one of an acceleration, an orientation, a position, a velocity, a parameter associated with another object in the vicinity, a signal from another device in the vicinity, and/or a biometric parameter associated with the wearer of the device.

3. The device of claim 2 further comprising a processor and a memory unit whereby the processor receives a sensor signal and stores the sensor signal in the memory unit.

4. The device of claim 2 further comprising a transmitter whereby the transmitter receives a sensor signal and sends the sensor signal using a wireless protocol.

5. The device of claim 2 further comprising a signaling element whereby the signaling element produces a signal capable of being detected by a human selected from the group of an auditory signal, a visual signal, and/or a tactile signal.

6. The device of claim 2 further comprising a fifth layer adjacent to and further from a user's body than the fourth layer wherein the fifth layer comprises an inflatable air bag and wherein the air bag inflates in response to a signal from the sensor.

7. The device of claim 2 wherein the sensor further comprises a sensor capable of measuring a biometric parameter from the group of blood pressure, pulse, body temperature, oxygen saturation, electro-cardio activity, brain activity, and/or neural activity.

8. The device of claim 1 wherein the device is a helmet.

9. The device of claim 1 wherein one of the second and third layers further comprises a damping feature that has a greater resistance to a high-speed impact than for a lower-speed impact.

10. The device of claim 9 wherein the damping feature comprises an air pocket having a hole that acts as a valve.

11. The device of claim 1 wherein one of the second and third layers further comprises at least one sealable air chamber.

12. The device of claim 1 wherein one of the second and third layers further comprises a material selected from the group of carbon fiber, nanometer-scale carbon nanotubes, polymers, glass fiber, and/or metals.

13. The device of claim 1 wherein the first layer comprises a polymer material.

14. The device of claim 1 wherein the fourth layer comprises a material selected from the group of carbon fibers, nanometer-scale carbon nanotubes, polymers, aramids, glass fibers, metals, and/or metalloids.

15. The device of claim 1 wherein the force-displacement relationship for the third layer is not the same as the force-displacement relationship for the second layer.

16. The device of claim 1 wherein the contact between the impression in the second layer and the impression in the third layer is an aligned contact.

17. The device of claim 1 wherein the contact between the impression in the second layer and the impression in the third layer is an offset contact.

18. The device of claim 1 wherein elastic deformation comprises elastic deformation from a plurality of elastic elements having different force-deflection characteristics and wherein said elastic elements are located in series wherein the elements carry the same force but have different deflections.

19. The device of claim 1 wherein elastic deformation comprises elastic deformation from a plurality of elastic elements having different force-deflection characteristics and wherein said elastic elements are located in parallel wherein the elements deflect the same distance but carry force independently of one another.

20. The device of claim 1 wherein one of the second layer and/or the third layer elastically deforms and returns to its original configuration in response to a force perpendicular to the fourth layer.

21. The device of claim 1 wherein one of the second layer and/or the third layer elastically deforms and returns to its original configuration in response to a force parallel to the fourth layer.

22. An impact reduction pad for protecting a human body from impact, comprising:

a first layer located closest to the wearer's body comprising a flexible material configured to conform to the shape of the wearer's body;

a second layer located outside of the first layer comprising an elastically-deformable material having at least one resilient impression arranged and configured to at least partially compress upon application of a force and to return elastically to its original shape upon removal of the force;

a third layer located outside of the first layer comprising an elastically-deformable material having at least one resilient impression arranged and configured to at least partially compress upon application of a force and to return elastically to its original shape upon removal of the force; and a fourth layer located furthest from the wearer's body wherein the fourth layer is more rigid than the first layer whereby the fourth layer can distribute an external impact over a region.

23. A method for reducing the damage to a human resulting from an external impact, the method comprising the steps of:

providing a first layer located closest to the wearer's body comprising a flexible material configured to conform to the shape of the wearer's body;

providing a second layer located outside of the first layer comprising an elastically-deformable material having at least one resilient impression arranged and configured to at least partially compress upon application of a force and to return elastically to its original shape upon removal of the force;

providing a third layer located outside of the second layer comprising an elastically-deformable material having at least one resilient impression arranged and configured:

to contact and transmit a force to said resilient impression in the second layer;

to at least partially compress upon application of a force; and to return to its original shape upon removal of a force; and providing a fourth layer located furthest from the wearer's body wherein the fourth layer is more rigid than the first layer whereby the fourth layer can distribute an external impact over a region.

* * * * *